United States Patent [19]

Loomis et al.

[11] Patent Number: 5,046,545

[45] Date of Patent: Sep. 10, 1991

[54] TENSION MOUNTING SYSTEM AND ASSEMBLY

[75] Inventors: Russell M. Loomis, Palos Heights, Ill.; Joseph K. Favata, 1801 S. Austin Blvd., Cicero, Ill. 60650

[73] Assignee: Joseph K. Favata, Cicero, Ill.

[21] Appl. No.: 131,217

[22] Filed: Dec. 10, 1987

Related U.S. Application Data

[63] Continuation-in-part of Ser. No. 99,056, Sep. 21, 1987.

[51] Int. Cl.[5] ..... E06B 3/00

[52] U.S. Cl. ..... 160/368.1; 160/378; 160/328; 38/107.91

[58] Field of Search ..... 160/368.1, 378, 375; 38/102.1, 102.91; 248/231.4, 231.1, 488

[56] References Cited

U.S. PATENT DOCUMENTS

| | | | |
|---|---|---|---|
| 2,212,313 | 8/1940 | Avenson . | |
| 2,218,451 | 10/1940 | Heyne | 160/378 X |
| 2,533,565 | 12/1950 | Eichelman . | |
| 2,799,464 | 7/1957 | D'Azzo | 160/387 |
| 3,553,862 | 1/1971 | Hamu | 38/102.1 |
| 3,591,940 | 7/1971 | Siemmons . | |
| 3,758,972 | 9/1973 | Egermayer . | |
| 3,830,278 | 8/1974 | Packer . | |
| 3,978,905 | 9/1976 | de Lama et al. | 160/378 |
| 4,041,861 | 8/1977 | Alter | 38/102.91 X |
| 4,233,765 | 11/1980 | O'Mullan et al. . | |
| 4,265,039 | 5/1981 | Brooks . | |
| 4,317,302 | 3/1982 | Von de Linde . | |
| 4;372,071 | 2/1983 | Vicimo . | |
| 4,452,000 | 6/1984 | Gandy . | |
| 4,657,062 | 4/1987 | Tuerk . | |
| 4,800,947 | 1/1989 | Loomis | 160/368.1 |

*Primary Examiner*—Blair M. Johnson
*Attorney, Agent, or Firm*—Thomas W. Speckman; Douglas H. Pauley

[57] ABSTRACT

A tension mounting system and assembly for suspending a flexible sheet material in a taut condition from a generally planar support surface and providing selective tension adjustment of the flexible sheet material is provided. The mounting system and assembly is especially suitable for use in signs displaying advertising material, such as billboards, signboards, and the like.

20 Claims, 3 Drawing Sheets

TENSION MOUNTING SYSTEM AND ASSEMBLY

CROSS REFERENCE TO RELATED APPLICATION

This application is a continuation-in-part of copending U.S. Pat. application Ser. No. 099,056, filed Sept. 21, 1987.

BACKGROUND OF THE INVENTION

1. Field of the Invention

The present invention relates to a tension mounting system and assembly whereby a flexible sheet material may be suspended in a taut condition from a generally planar support surface. The mounting system and assembly of the present invention is particularly suitable for use in signs displaying advertising material, such as billboards, signboards, and the like.

2. Description of the Prior Art

Display signs have been used for a variety of purposes and in a variety of applications, typically for promoting a business or a product. Conventional billboards generally comprise a planar rigid support surface, or a plurality of such surfaces mounted adjacent one another, upon which the advertising message is painted. Alternatively, the advertising material may be painted or printed on paper or another sheet-like material which is then affixed to the planar rigid support surface, typically by means of adhesives. In many cases, the billboard comprises a freestanding structure mounted on the ground or on a building or the like, and it may be illuminated by spotlights, or the like, to provide visibility during the nighttime. In some cases, advertising material is applied directly to the surfaces of a building structure itself because the building structure cannot support the weight of a billboard support structure. These types of conventional billboards are very expensive to erect and maintain because preparation and maintenance, in particular, are labor intensive operations. The appearance of conventional billboards is also apt to deteriorate rapidly due to weather conditions such as sun, precipitation, changes in temperature, and the like.

Signs comprising a substantially rigid sheet of transparent or translucent material upon which an advertising message has been applied have also been utilized, generally by mounting them in a cabinet and illuminating the sheet material bearing the advertising message from inside the cabinet. These types of display signs generally exhibit less deterioration due to weather conditions, but the size of the display sign is quite limited, since transport and installation of a large, substantially rigid sheet is impracticable. In addition, these materials exhibit at least some resiliency, which limits the practical dimensions of the sign, and tends to result in distortion or bowing of the sign due to the weight of the material and due to adverse weather conditions, such as high winds.

Recent innovations in the advertising industry include the use of a flexible, fabric-like sheet material which is light, relatively impervious to weather, and may be illuminated from behind to provide an attractive and effective display. This material is preferably suspended in a taut condition to provide a planar display surface. The costs associated with installation and maintenance of display signs comprising a flexible sheet material are generally less than those associated with conventional signboards and billboards, since the advertising message may be applied at a central location, and the sheet material may be rolled or folded for convenient transport to the display location. The flexible fabric-like sheet material may be applied over or suspended from a conventional billboard support surface or a building support structure.

Means for mounting and/or framing flexible paper and synthetic sheet-like materials are known to the art. U.S. Pat. No. 2,212,313 teaches a display panel wherein a flexible, replaceable cover is mounted to a rigid rail at each longitudinal edge, and the longitudinal edges are wrapped around upright tubular structures and anchored to cross members by means of springs. U.S. Pat. No. 2,533,565 teaches a display frame for retaining a flexible display panel in a taut condition generally parallel to a backing board by means of spring clips along one edge and rigid clips along the opposite edge. U.S. Pat. No. 3,591,940 teaches a supporting frame for releasably clamping flexible sheet materials, such as posters, to the frame means. The poster is fastenable to opposite frame members by clamp means and a spring may be wedged between the frame members to provide the desired tension. U.S. Pat. No. 3,758,972 teaches a sign housing with a removably mounted sign panel wherein the edges of the sign sheet and a protective cover sheet are retained between nesting members of the panel frame. U.S. Pat. No. 3,830,278 teaches a modular canvas stretcher wherein canvas is fastened to the stretcher frame comprising rigid, mitered elongated members having longitudinal channels for retaining bracket members and bracing members. U.S. Pat. No. 4,233,765 teaches a peripheral framework for suspending flexible sheet materials over a central open area. The peripheral framework is provided with a channel for receiving a flexible strip member, by which the flexible material is engaged between the channel and the strip member.

U.S. Pat. No. 4,317,302 teaches a sign cabinet for outdoor signs comprising a support frame with clamp assemblies for retaining a flexible sign face under tension. U.S. Pat. No. 4,452,000 teaches an illuminatable sign and framework housing therefor, wherein a sheet of flexible, light-transmitting material extends across and covers an opening, and bolts secure a peripheral marginal portion of the sheet by adjustably tensioning the sheet across the opening. U.S. Pat. No. 4,372,071 teaches a fabric faced billboard wherein air pressure is applied from behind the fabric to smooth the fabric and provide a continuous, slightly curved display face.

U.S. Pat. No. 4,265,039 teaches a framework for suspending a fabric display face and a clamp assembly for selective adjustment of fabric tension. The '039 patent teaches that prior art clamp assemblies required spaced holes to be punched in the fabric display through which bolts of the clamp assemblies were passed. The clamp assemblies were tightened around the fabric by means of a first nut, and the fabric was then tensioned by means of a second nut drawing the suspended clamp toward the mounted bracket. This system is undesirable from the standpoint that a plurality of holes are required in the fabric sign at prescribed intervals, and the fabric sign is prone to tearing during installation. In addition, multiple adjustments of the multiplicity of clamp assemblies to first tighten the clamp assembly around the fabric and then tension the fabric, is tedious and time consuming. The '039 patent teaches a fastening assembly having upper and lower support elements joined between corresponding opposite ends by respective side support elements. A hinge element is affixed to at least one of the support elements, and a hinge pin to which a marginal portion of the fabric is coupled may undergo limited rotation in conjunction with the hinge element to provide selective adjustment of the tension induced in the fabric.

U.S. Pat. No. 4,657,062 teaches an adjustable clamping system for tensioning and locking a flexible tarp. The '062 patent teaches a roll bar for fastening an edge of the flexible tarp to the clamping means. Roll bars of this type having a groove for retaining an enlarged or supported edge of the flexible tarp may be used in the practice of the present invention.

It is evident from the above recitation of prior art patents that the use of flexible sheet materials for outdoor displays and signboards is known, and that a variety of support structures and tensioning mechanisms has been proposed. None of the prior art systems, however, provides satisfactory and selective tensioning of the flexible sheet-like material in combination with a simplified and convenient assembly technique.

SUMMARY OF THE INVENTION

It is an objective of the present invention to provide a simplified tension mounting system and assembly wherein a flexible, sheet-like material may be suspended in a taut condition from a generally planar support surface and selectively tensioned by a plurality of bracket means which are fastenable to existing billboard structures, building support structures such as walls and roofs, and the like.

It is another objective of the present invention to provide a tension mounting system and assembly which facilitates installation and removal of flexible, sheet-like materials without requiring disassembly of mounting brackets.

It is still another objective of the present invention to provide clamping and selective tension adjustment of the flexible, sheet-like material by means of a single adjustment mechanism on each of a plurality of bracket means.

It is yet another objective of the present invention to provide a tension mounting system and assembly for suspending a flexible sheet material in a taut condition which is versatile and may be adapted to a variety of sign sizes, weights and designs.

It is yet another objective of the present invention to provide a simplified, compact tension mounting system and assembly which is suitable for suspending a flexible sheet material in a taut condition from a building wall, a trailer truck, a railroad car, or the like, which does not interfere with required clearances of the support surface, and in which the mounting means are hidden from view.

The tension mounting assembly of the present invention comprises a flexible, sheet-like material with a retaining means extending around at least a portion of its peripheral edges, and a plurality of bracket means fastened to a generally planar support surface and arranged along at least two opposite edges of the flexible, sheet-like material, each bracket means adapted to clamp the retaining means and provide selective tensioning of the flexible sheet-like material by means of a single adjustment mechanism. The tension mounting system and assembly of the present invention is especially preferred for use in display signs and billboards for exhibiting an advertising message, but may also be used in any application where suspension of a flexible sheet material in a taut condition is desired.

BRIEF DESCRIPTION OF THE DRAWINGS

Further features of the present invention will be apparent from the following more detailed description of the invention read in conjunction with the drawings, wherein.

DESCRIPTION OF PREFERRED EMBODIMENTS

Figure 1:
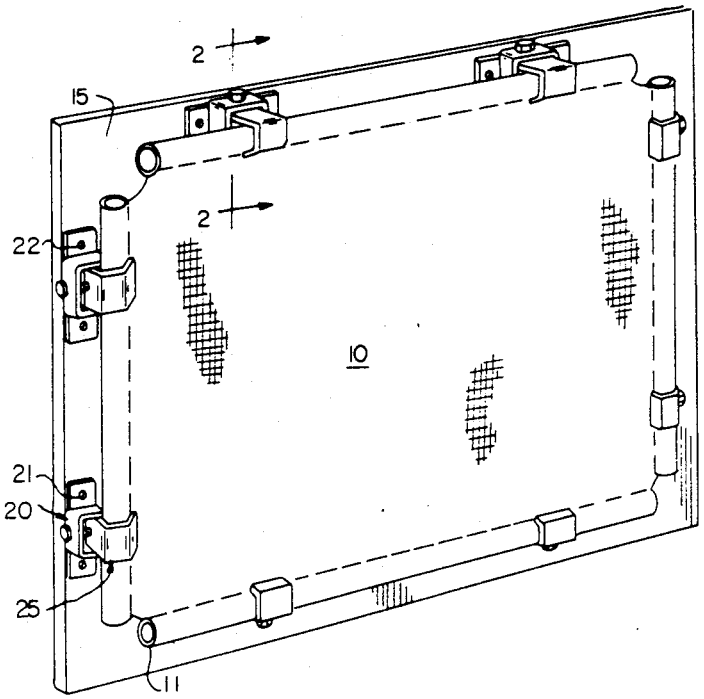
FIG. 1 shows a perspective view of the tension mounting assembly of the present invention.

As shown in FIG. 1, the tension mounting system and assembly of the present invention comprises flexible sheet material 10 provided with rigid retaining means 11 along its peripheral edges, and a plurality of bracket means 20 fastened to support surface 15 and spaced at intervals along at least two opposite peripheral edges of flexible sheet 10. Flexible sheet material 10 may comprise any flexible, fabric-like material, and preferably comprises a sheet material reinforced to provide strength and durability. Synthetic materials and multilaminates which are weather-resistant are especially preferred, and suitable materials are well known to the art. Suitable means for applying an advertising message to the surface of flexible sheet 10, such as by painting, printing, silk screening, and the like, are also well known to the art.

At least a portion of the peripheral edges of flexible sheet 10 are mounted on rigid retaining means 11. According to the illustrated embodiments, a peripheral edge of flexible sheet material 10 forms a loop with the edge of flexible sheet 10 fastened to flexible sheet 10 at attachment point 12 by stitching, adhesives, or other fastening means known to the art. Rigid retaining means 11 are insertable in the loops thus formed at the peripheral edges of flexible sheet 10. Flexible sheet material 10 may be mounted on rigid retaining means 11 by other fastening means, such as adhesives, but the embodiment illustrated in the drawings is preferred for most applications.

Rigid retaining means 11 preferably comprise a lightweight metallic or rigid plastic material, and may be in the form of a tube or bar, or may have any cross-sectional configuration which is convenient for a particular application. Rigid retaining means 11 are preferably hollow, as shown, to reduce the weight of the assembly. Rigid retaining means 11 may be mounted at the peripheral edges of flexible sheet 10 at the assembly site to facilitate transport of the components to the site. Rigid retaining means 11 are preferably mounted at least at two opposite peripheral edges of flexible sheet 10 and are most preferably mounted along each peripheral edge of flexible sheet 10. Rigid retaining means 11 may be provided along the length of a peripheral edge, or rigid retaining means 11 may be provided in shorter lengths, and mounted at intervals along the peripheral edges of flexible sheet 10. Provision of a separate but continuous rigid retaining means 11 along the length of each peripheral edge of flexible sheet material 10 is preferred.

As shown in the perspective view of FIG. 1, a plurality of bracket means 20 are affixed to a generally planar support surface 15 for suspending flexible sheet 10 generally parallel to planar support surface 15, and for selectively tensioning flexible sheet 10. Each bracket means 20 preferably comprises at least two flanges 21 disposed on opposite sides of the bracket from one another for attachment to support surface 15. One or more bores are provided in each attachment flange 21 for receiving fasteners 22, and different types of fasteners 22 may be utilized, depending upon the composition of support surface 15. For example, support surface 15 may comprise all or a portion of an existing wooden or metallic billboard structure, or planar support surface 15 may be a building structure surface comprising wood, brick, cement, metal, or the like. Suitable fasteners 22 for attachment of bracket means 20 to support surface 15 are known to the art.

Bracket means 20 further comprises top wall 23 oriented in a plane substantially perpendicular to attachment flanges 21, and side walls 24 extending substantially perpendicular to top wall 23 and attachment flanges 21. Side walls 24 are preferably continuous with or rigidly fixed to attachment flanges 21 at one edge, while the opposite terminal edges 34 of side walls 24 form a clamp in combination with adjustable bracket arm 25. Top wall 23 is preferably continuous with or rigidly fixed to side walls 24. It is to be understood that the designation of top wall 23 does not necessarily indicate orientation of the wall with respect to the ground, since bracket means 20 may be mounted on support surface 15 in a variety of orientations and, for example, bracket means 20 mounted at opposite peripheral edges of flexible sheet 10 are mounted at an orientation rotated 180° from one another.

Figure 2:
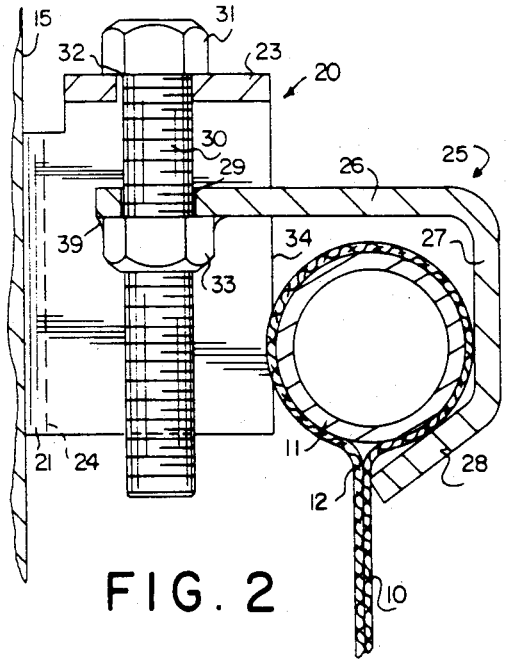
FIG. 2 shows an enlarged cross-sectional side view of the flexible sheet material suspended from a bracket means taken through line 2—2 of FIG. 1.
Figure 3:
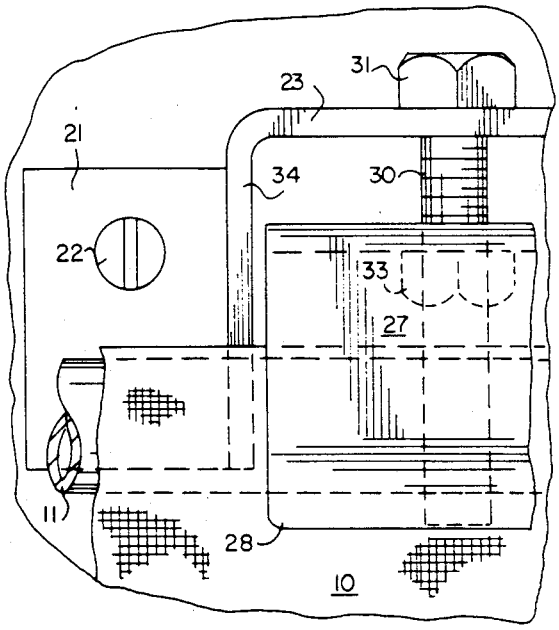
FIG. 3 shows an enlarged front view of the bracket means of FIG. 2.
Figure 6:
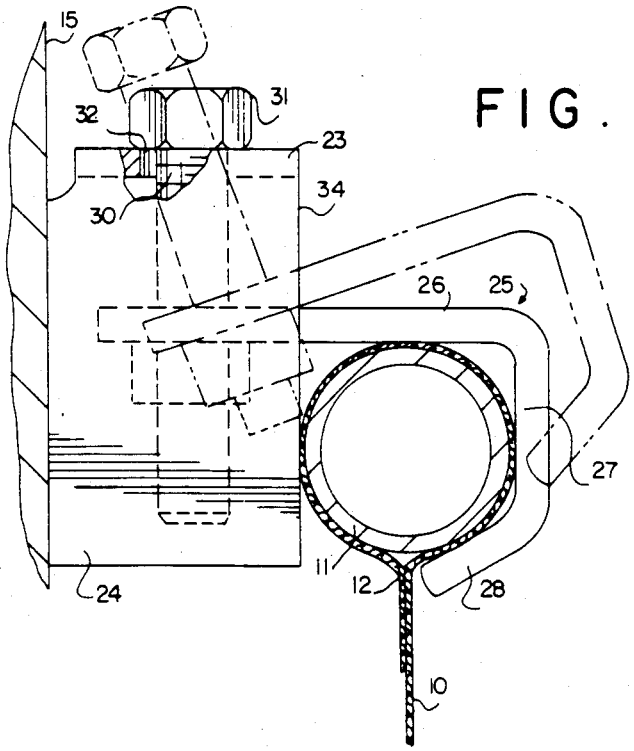
FIG. 6 shows a side view of the bracket means shown in FIG. 2 illustrating, in dashed lines, adjustment of the bracket arm during installation.

Threaded adjustment means 30 penetrates bore 32 in top wall 23, and also penetrates bore 29 in adjustable bracket arm 25. Bore 32 in top wall 23 is preferably located centrally with respect to side walls 24, and is preferably larger in diameter than threaded adjustment means 30 and smaller in diameter than head 31 at one terminal end of threaded adjustment means 30, as shown in FIG. 2. Threaded adjustment means 30 attached to adjustable bracket arm 25 is thus pivotable with respect to the central longitudinal axis of bore 32, as illustrated in FIG. 6, to facilitate insertion of rigid retaining means 11 in adjustable bracket arm 25.

Adjustable bracket arm 25 preferably comprises first leg 26 having bore 29 for receiving threaded adjustment means 30, first leg 26 extending beyond terminal edges 34 of side walls 24 and continuous with or rigidly fixed to second leg 27. Second leg 27 is preferably oriented generally perpendicular to first leg 26 and generally parallel to attachment flanges 21 and is continuous with or rigidly attached to first leg 26 and third leg 28. The inner surface of third leg 28 is preferably at an obtuse angle of from about 110° to about 135° with respect to the inner surface of second leg 27. Third leg 28 extends for less than the distance between terminal edges 34 of side walls 24 and second leg 27 to provide access for insertion and clamping of rigid retaining means 11 within adjustable bracket arm 25.

Nut 33 may be rigidly attached, such as by welds 39, to first leg 26 of adjustable bracket arm 25 and aligned with bore 29. Nut 33 is internally threaded to match the external threads on threaded adjustment means 30, and threaded adjustment means 30 is thereby threadedly engageable on fixed nut 33. Alternatively, bore 29 in first leg 26 of adjustable bracket arm 25 may be provided with internal threads matching the external threads on threaded adjustment means 30 so that threaded adjustment means 30 is threadedly engageable in bore 29. As threaded adjustment means 30 is rotated in one direction, adjustable bracket arm 25 is axially displaced toward top wall 23 and, conversely, as threaded adjustment means 30 is rotated in the opposite direction, adjustable bracket arm 25 is axially displaced away from top wall 23.

When bore 32 in top wall 23 has a larger diameter than threaded adjustment means 30, threaded adjustment means 30 is pivotable with respect to the central longitudinal axis of bore 32, thereby enlarging the gap between the terminal end of third leg 28 and the terminal edges 34 of side walls 24, and permitting rigid retaining means 11 to be introduced into adjustable bracket arm 25. Threaded adjustment means 30 may then be rotated to axially displace adjustable bracket arm 25 toward top wall 23, thereby clamping rigid retaining means 11 between the inner surfaces of adjustable bracket arm 25 and terminal edges 34 of side walls 24. Additional rotation of threaded adjustment means 30 will result in axial displacement of adjustable bracket arm 25 and rigid retaining means 11 toward top wall 23, thereby tensioning flexible sheet 10.

Figure 4:
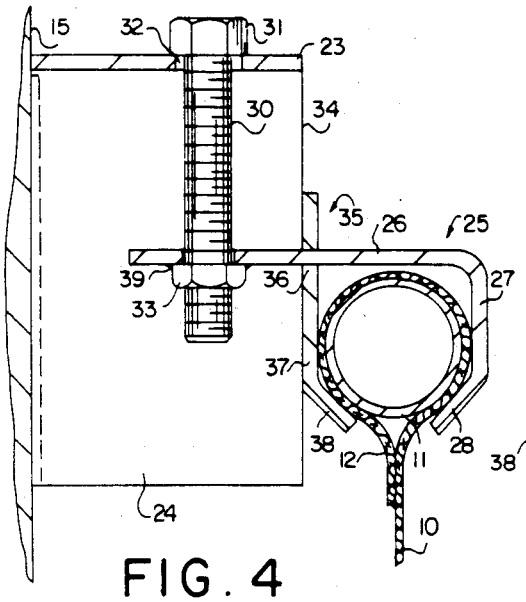
FIG. 4 shows an enlarged cross-sectional side view of another embodiment of a bracket means suitable for use in the tension mounting assembly of the present invention.
Figure 5:
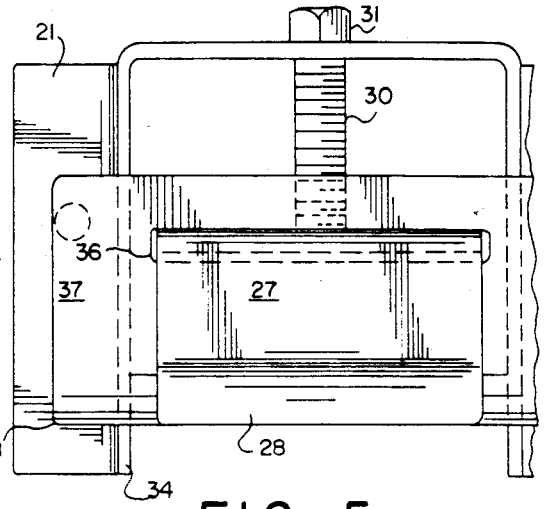
FIG. 5 shows a front view of the bracket means shown in FIG. 4.

FIGS. 4 and 5 show another embodiment of bracket means 20 of the present invention. As shown in FIG. 4, bracket arm 25 may additionally comprise inner bracket arm 35 having first component 37 oriented substantially parallel to second leg 27 of adjustable bracket arm 25, and second component 38 provided at substantially the same angle with respect to first component 37 as third leg 28 is to second leg 27 of adjustable bracket arm 25. Inner bracket arm 35 may be rigidly attached to adjustable bracket arm 25, but is preferably adjustably mounted on adjustable bracket arm 25 by means of slot 36 receiving first leg 26 of adjustable bracket means 25, as shown in FIGS. 4 and 5. Provision of slot 36 permits threaded adjustment means 30 to pivot with respect to the central longitudinal axis of bore 32, thereby enlarging the gap between the terminal ends of adjustable bracket arm 25 and inner bracket arm 35 and permitting rigid retaining means 11 to be inserted between adjustable bracket arm 25 and inner bracket arm 35. Rotation of threaded adjustment means 30 causes axial displacement of adjustable bracket arm 25, inner bracket arm 35 and threaded nut 33 along the central longitudinal axis of bore 32.

FIG. 5 illustrates a preferred embodiment of the bracket means shown in FIG. 4 wherein first component 37 and second component 38 of inner bracket arm 35 are wider than the corresponding walls of adjustable bracket arm 25 and top wall 23, and first component 37 of inner bracket arm 35 abuts terminal edges 34 of side walls 24. This embodiment of bracket means 20 prevents friction from occurring due to contact of flexible sheet 10 with terminal edges 34 of side walls 24, since flexible sheet 10 contacts only smooth, continuous surfaces of adjustable bracket arm 25 and inner bracket arm 35. Insertion of rigid retaining means 11 in bracket means 20, and tensioning of flexible sheet 10 may thus be achieved without causing rubbing or clamping friction at any point on flexible sheet 10.

The tension mounting system of the present invention operates as follows to provide suspension and selective tensioning of sheet material 10. Sheet material 10 is provided as desired with suitable advertising material, or the like, and is provided with suitable means for attachment of rigid retaining means 11 at a remote location and conveniently transported to the assembly site. Likewise, a plurality of rigid retaining means 11 and bracket means 20 may also be conveniently transported to the assembly site.

A plurality of bracket means 20 are provided for suspending and selectively tensioning flexible sheet material 10 at least at two opposite peripheral edges of flexible sheet material 10. For example, bracket means 20 may be provided only along the top and bottom peripheral edges of flexible sheet 10, or bracket means 20 may be provided only at the side peripheral edges of flexible sheet 10. For most applications, and particularly those in which flexible sheet 10 comprises a relatively large surface area, bracket means 20 are preferably provided at intervals along each peripheral edge of flexible sheet 10. At least two bracket means 20 are preferably provided at each peripheral edge, and additional bracket means may be provided where the surface area and/or weight of flexible sheet 10 requires additional support.

Bracket means 20 are mounted on support surface 15 at appropriate intervals in accordance with the dimensions of flexible sheet 10. Rigid retaining means 11 may be mounted at the peripheral edges of flexible sheet 10 at the assembly site, and insertion of rigid retaining means 11 into adjustable bracket arm 25 of each bracket means 20 may be achieved by sequentially pivoting each adjustable bracket arm 25 and rotating threaded adjustment means 30 to axially displace adjustable bracket arm 25 sufficiently to clamp rigid retaining means 11 between the inner surfaces of adjustable bracket arm 25 and terminal edges 34 of side walls 24 of bracket means 20. Rigid retaining means 11 may be sequentially clamped within the adjustable bracket arm of each bracket means 20 in this fashion. Flexible sheet 10 is then suspended, and selective tensioning may be provided by further rotation of threaded adjustment means 30 at appropriate bracket means 20, as necessary, to provide flexible sheet 10 in a taut and wrinkle-free condition.

Figure 7:
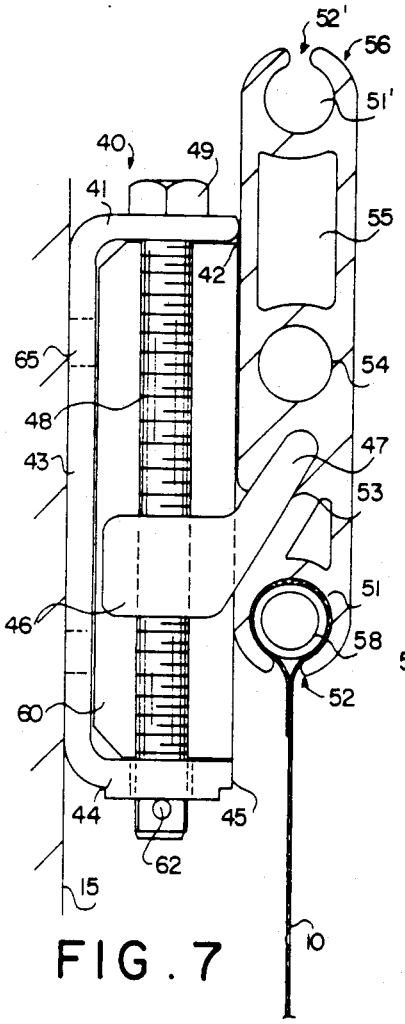
FIG. 7 shows a side view of another embodiment of the tension mounting assembly of the present invention.
Figure 8:
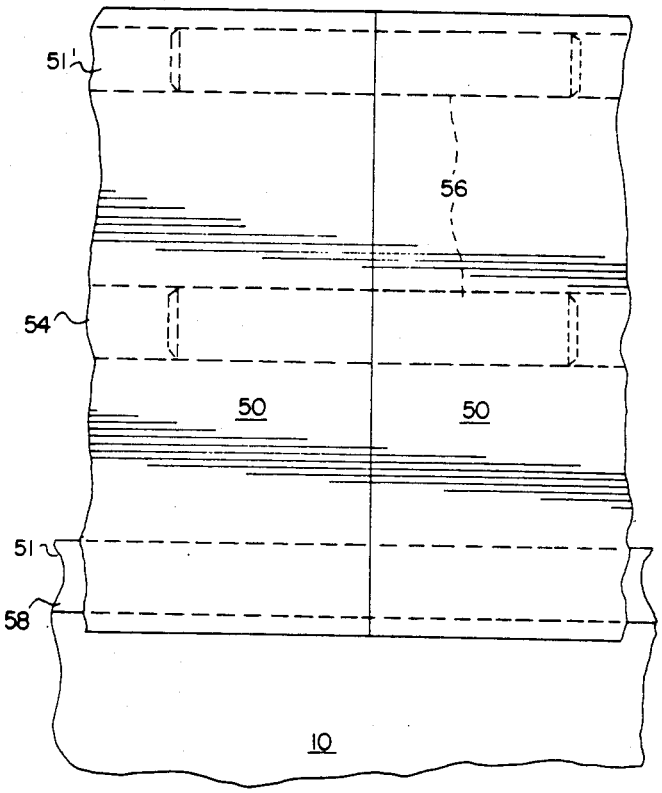
FIG. 8 shows a front view of the tension mounting assembly illustrated in FIG. 7 with two rigid support means joined together.
Figure 9:
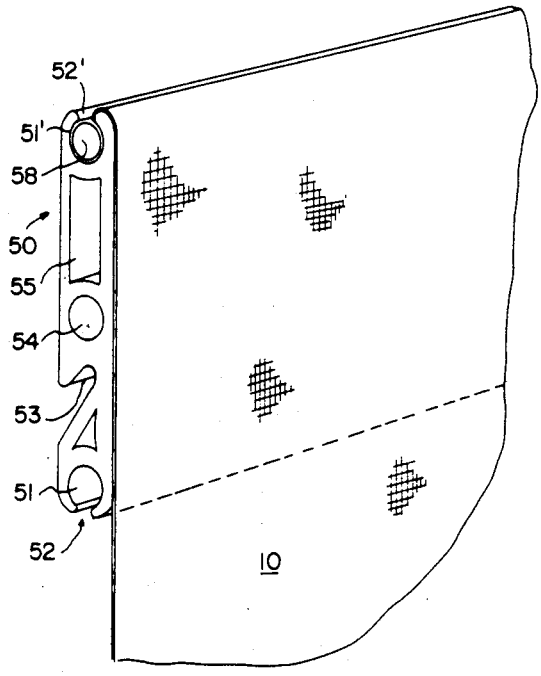
FIG. 9 shows a perspective side view of the rigid support means substantially as shown in FIG. 7 with flexible sheet material suspended therefrom.

FIGS. 7–9 illustrate another embodiment of the tension mounting assembly of the present invention. As in the previously described embodiments of the tension mounting assembly, rotation of a threaded adjustment means induces axial displacement of the means supporting the flexible sheet material to provide suspension and selective tensioning of the flexible sheet material. This embodiment provides a compact tension mounting assembly which is suitable for suspending a flexible sheet material in a taut condition from a building wall, trailer truck, railroad car, or the like, which does not interfere with required clearances for the support surfaces, and in which the support means and/or the bracket means may be hidden from view.

As shown in FIG. 7 and FIG. 8, the tension mounting assembly comprises bracket means 40 and rigid support means 50 in addition to flexible sheet 10 and enlarged retaining means 58 mounted at least at one peripheral edge of flexible sheet 10. Enlarged retaining means 58 may comprise a variety of rigid or semi-rigid materials, such as rigid metallic or plastic tubing, rope, cable, bars, or any material which is not altered in configuration as a result of forces exerted on it against a rigid structure. Enlarged retaining means 58 must be capable of remaining substantially unchanged in configuration when sheet material 10 is suspended under high tension forces.

Enlarged retaining means 58 are mounted along the peripheral edges of flexible sheet 10. According to the illustrated embodiment, a peripheral edge of flexible sheet material 10 forms a loop in which enlarged retaining means 58 is insertable. Other suitable means of supporting enlarged retaining means 58 are known to the art. At least one enlarged retaining means 58 is mounted along at least one peripheral edge of flexible sheet 10, and, according to an especially preferred embodiment, enlarged retaining means 58 are provided continuously along all peripheral edges of flexible sheet 10.

Bracket means 40 comprises a rigid, generally C-shaped bracket having first leg 41 rigidly attached and oriented generally perpendicularly with respect to second leg 43, which is rigidly attached and oriented generally perpendicularly with respect to third leg 44. First leg 41 and third leg 44 are thus oriented substantially parallel to one another, and terminal edge 42 of first leg 41 is preferably generally aligned with terminal edge 45 of third leg 44. Second leg 43 is provided with attachment means, such as bores 65 and suitable fasteners, or other attachment means which are known to the art and which are capable of securely fastening second leg 43 of bracket means 40 to support surface 15. First leg 41 and third leg 44 are provided with aligned bores for receiving threaded adjustment means 48. The bores are preferably generally centrally arranged in first leg 41 and third leg 44, are not threaded, and are sized to accommodate and retain threaded adjustment means 48 in a rotatable but stationary condition with respect to the central longitudinal axis of threaded adjustment means 48. Enlarged head 49 of threaded adjustment means 48 retains threaded adjustment means 48 on bracket means 40, and retainer 62, such as a pin, cotter pin, or the like, preferably provided at the opposite end of threaded adjustment means 48 to retain threaded adjustment means 48 in an axially immovable condition on bracket means 40.

Adjustable arm means 46 may be internally threaded and thus directly engageable on threaded adjustment means 48, as shown in FIG. 7, or adjustable arm means 46 may be rigidly attached to an internally threaded nut, as previously described with reference to adjustable bracket arm 25 and shown in FIGS. 2–6. Adjustable arm means 46 is threadedly engaged on threaded adjustment means 48 between first leg 41 and third leg 44 of bracket means 40. Internally threaded adjustable arm means 46 is provided with angled projection 47 which extends beyond terminal edges 42 and 45 of first leg 41 and third leg 44, respectively, and is oriented at an obtuse angle with respect to first leg 41 and third leg 44.

According to a preferred embodiment of the present invention, channel-shaped reinforcement means 60 is mounted to the inner surfaces of bracket means 40. Reinforcement means 60 preferably comprises two parallel walls having generally rectangular surfaces defined by the inner surfaces of legs 41, 43 and 44 of bracket means 40 and terminal edges 42 and 45 of first and third legs 41 and 44, respectively. The two parallel walls of channel-shaped reinforcement means 60 extend parallel to threaded adjustment means 48, are provided adjacent adjustable arm means 46, and are joined by a perpendicular wall extending parallel to and abutting second leg 43 of bracket means 40. Reinforcement means 60 may be secured to bracket means 40 by a variety of means which are known to the art, or reinforcement means 60 may be provided with attachment bores aligned with bores 65 in second leg 43 for attachment of bracket means 40 to support surface 15. Reinforcement means 60 serves to reinforce bracket means 40, particularly at first leg 41 and third leg 44, prevents adjustable arm means 46 from rotating on threaded adjustment means 48, and facilitates alignment of support means 50 parallel to support surface 15. Reinforcement means 60 may alternatively be provided as generally rectangular plates or walls adjacent adjustable arm means 46 and having a surface area defined by the inner surfaces of legs 41, 43 and 44 of bracket means 40 and terminal edges 42 and 45 of first and third legs 41 and 44, respectively.

Rigid support means 50 preferably comprises a separate component having at least one continuous bore 51 accommodating enlarged retaining means 58 and a continuous access opening 52 adjacent continuous bore 51, and preferably extending along a central portion of a first longitudinal edge. As shown in FIG. 7, continuous bore 51 is sized to accommodate enlarged retaining means 58 mounted at a peripheral edge of flexible sheet 10 and access opening 52 is sized to accommodate passage of flexible sheet 10. Rigid support means 50 may additionally comprise a second continuous bore 51' capable of retaining enlarged retaining means 58 and a second continuous access opening 52' adjacent continuous bore 51' and preferably extending along a central portion of a second longitudinal edge. According to this embodiment, enlarged retaining means 58 mounted at a peripheral edge of flexible sheet 10 may be suspended from a second longitudinal edge of rigid support means 50, shown as the upper edge in FIG. 9, whereby flexible sheet 10 conceals rigid support means 40 from view, as well as from a first longitudinal edge, shown as the lower edge in FIGS. 7 and 8, whereby rigid support means 50 provides a visible framework around flexible sheet 10. A double-sided display may also be provided according to this embodiment, with a first flexible sheet suspended from one continuous bore, and a second flexible sheet suspended from the other continuous bore.

Rigid support means 50 additionally comprises a continuous angled groove 53 having a configuration and dimension designed to accommodate angled projection 47 extending from internally threaded adjustable arm means 46. Projection 47 is engageable in and slidable along continuous angled groove 53. Continuous groove 53 is provided in a lower portion of rigid support means 50 to provide a tension mounting assembly wherein bracket means 40 are hidden from view. The height of rigid support means 50 between the upper and lower longitudinal edges preferably corresponds at least to the distance between first leg 41 and third leg 44 of bracket means 40. In this way, bracket means 40 and threaded adjustment means 48 are not visible to a person viewing advertising material provided on flexible sheet 10.

Rigid support means 50 preferably comprises a rigid metallic or synthetic plastic material which may be machined, formed, or extruded to provide the necessary bores, grooves, and the like. The outwardly facing surface of rigid support means 50 may be smooth as shown, or it may be ribbed to provide a decorative framework for flexible sheet 10. Rigid support means 50 may be provided with one or more cutout portions 55 to reduce the weight of the support means. Rigid support means 50 may be aligned and assembled using one or more splice pins 56 insertable in one or more bores 54, 51, to join a plurality of rigid support means consecutively, forming a continuous support means framework.

Assembly and disassembly of the tension mounting assembly shown in FIGS. 7–9 proceeds in generally the same fashion as described above with reference to the embodiments illustrated in FIGS. 1–6. Bracket means 40 may be fastened to support surface 15 at locations corresponding to the peripheral edges of flexible sheet 10 bearing enlarged retaining means 58. Bracket means 40 are mounted on support surface 15 at appropriate intervals in accordance with the dimensions of flexible sheet 10, and the rigid support means, with at least one bracket means provided to mount each rigid support means. Bracket means 40 mounted on opposite peripheral edges of flexible sheet 10 are rotated 180° with respect to one another so that angled projections 47 of the center of adjustable arm means 46 extend away from the center of flexible sheet 10 to provide suitable tensioning means. Enlarged retaining means 58 may be mounted at the peripheral edges of flexible sheet 10 at the assembly site, if desired, and flexible sheet 10 may then be mounted on rigid support means 50 by sliding enlarged retaining means 58 in continuous bore 51 or 51' of rigid support means 50. Rigid support means 50 are provided in lengths substantially greater than the length of bracket means 40, and a plurality of rigid support means 50 may be aligned and joined along each peripheral edge of flexible sheet 10, as described previously. Enlarged retaining means 58 and bracket means 40 are provided at least at two opposite peripheral edges of flexible sheet 10 to provide suspension and selective tensioning of the flexible sheet material. It is possible to provide bracket means 40 along a single peripheral edge of flexible sheet 10 and to fixedly attach the opposite edge of flexible sheet 10 to the support surface, thus providing adjustable tensioning along only one peripheral edge of flexible sheet 10. It is preferred, for most applications, to provide bracket means at intervals along each peripheral edge of flexible sheet 10.

Continuous angled grooves 53 of rigid support means 50 are mounted on angled projections 47 of adjustable arm means 46 by means of appropriate adjustment of adjustable arm means 46, and flexible sheet 10 is thus suspended from support surface 15. Rotation of threaded adjustment means 48 axially displaces adjustable arm means 46 and rigid support means 50 with respect to bracket means 40. Selective tensioning may be provided by further rotation of threaded adjustment means 48 at appropriate bracket means 40 as necessary, to provide flexible sheet 10 in a taut and wrinkle-free condition.

The embodiment of the tension mounting system and assembly shown in FIGS. 7 and 8 is particularly suitable for applications where a continuous border around the material displayed on flexible sheet 10 is desired, and where a compact tension mounting assembly capable of suspending a flexible sheet at a short distance from a support surface is desired. This embodiment is particularly suitable for use on trailer trucks, railroad cars, and the like, where required clearances are of importance. According to the embodiment illustrated in FIG. 9, both the bracket means and the rigid support means are hidden from view, and only flexible sheet 10 is visible to the viewer.

Assembly and disassembly of the tension mounting system of the present invention may be achieved in a very short period of time. Assembly and disassembly of this tension mounting system does not require any specialized tools or skills, and suspension and removal of flexible sheets 10 may be achieved without disassembling the mounting brackets. The tension mounting system of the present invention is suitable for outdoor and indoor use. Decorative border and/or corner finishing pieces may be provided as desired to enhance the aesthetic appearance of the tension mounting assembly. The flexible sheet may be illuminated from behind by lights mounted on the support surface, since the configuration and dimensions of the bracket means may be varied to suspend the flexible sheet at any predetermined distance from the support surface.

While in the foregoing specification this invention has been described in relation to certain preferred embodiments thereof, and many details have been set forth for the purposes of illustration, it will be apparent to those skilled in the art that the invention is susceptible to additional embodiments and that certain of the details described herein may be varied considerably without departing from the basic principles of the invention.

I claim:

1. A tension mounting assembly for suspending flexible sheet material in a taut condition comprising:

a flexible sheet;

at least one rigid retaining member, at least a portion of at least one peripheral edge of said flexible sheet forming a closed loop, said at least one rigid retaining member mounted within said closed loop;

a generally planar support surface, bracket means attached to said generally planar support surface at locations corresponding to said at least one peripheral edge of said flexible sheet, said bracket means comprising a rigid, generally C-shaped bracket, a threaded adjustment means mounted on said generally C-shaped bracket, and an adjustable arm means threadedly engaged on said threaded adjustment means, said adjustable arm means comprising an angled projection extending away from said flexible sheet; and at least one rigid support means engaging each said at least one rigid retaining member mounted within said closed loop and each said rigid support means having engagement means engaging said adjustable arm means, whereby rotation of said threaded adjustment means causes axial displacement of said adjustable arm means, said rigid support means and said rigid retaining member, said axial displacement capable of tautening said flexible sheet.

2. A tension mounting assembly for suspending flexible sheet material in a taut condition according to claim 1 wherein said at least one rigid retaining member is mounted within each said closed loop on each of at least two peripheral edges of said flexible sheet, said bracket means are attached to said generally planar support surface at locations corresponding to each of said at least two peripheral edges of said flexible sheet, and at least one rigid support means engages each said rigid retaining member.

3. A tension mounting assembly for suspending flexible sheet material in a taut condition according to claim 2 wherein said at least one rigid retaining member is mounted within each said closed loop at each peripheral edge of said flexible sheet, and a plurality of bracket means are attached to said generally planar support surface at locations corresponding to each peripheral edge of said flexible sheet.

4. A tension mounting assembly for suspending flexible sheet material in a taut condition according to claim 3 wherein said flexible sheet is generally rectangular and at least one said rigid retaining extends continuously along each said peripheral edge of said flexible sheet.

5. A tension mounting assembly for suspending flexible sheet material in a taut condition according to claim 1 wherein each said at least one rigid support means is mounted on at least one said bracket means.

6. A tension mounting assembly for suspending flexible sheet material in a taut condition according to claim 1 wherein said bracket means comprises said generally C-shaped bracket having a first leg rigidly attached and oriented substantially perpendicular to a second leg provided with attachment means for attachment of said bracket means to said generally planar support surface, and a third leg rigidly attached and oriented substantially perpendicular to said second leg at a distance from said first leg, said first and third legs having bores receiving said threaded adjustment means.

7. A tension mounting assembly for suspending flexible sheet material in a taut condition according to claim 6 wherein said threaded adjustment means has a head at a first end large enough to retain said threaded adjustment means in said bore in said first leg of said bracket means, and additionally comprising a retainer means at a second end of said threaded adjustment means retaining said threaded adjustment means in said bore in said third leg of said bracket means.

8. A tension mounting assembly for suspending flexible sheet material in a taut condition according to claim 1 wherein each said support means has at least one continuous bore engaging said rigid retaining member mounted within said closed loop and at least one continuous access opening adjacent said at least one continuous bore.

9. A tension mounting assembly for suspending flexible sheet material in a taut condition comprising:

a flexible sheet;

at least one rigid retaining member, at least a portion of at least one peripheral edge of said flexible sheet forming a closed loop, said at least one rigid retaining member mounted within said closed loop;

a generally planar support surface, bracket means attached to said generally planar support surface at locations corresponding to said at least one peripheral edge of said flexible sheet, said bracket means comprising a rigid, generally C-shaped bracket, a threaded adjustment means mounted on said generally C-shaped bracket, and an adjustable arm means threadedly engaged on said threaded adjustment means, said adjustable arm means comprising an angled projection extending away from said flexible sheet;

at least one rigid support means engaging each said at least one rigid retaining member mounted within said closed loop and each said rigid support means having engagement means engaging said adjustable arm means, whereby rotation of said threaded adjustment means causes axial displacement of said adjustable arm means, said rigid support means and said rigid retaining member, said axial displacement capable of tautening said flexible sheet;

each said support means having at least one continuous bore engaging said rigid retaining member mounted within said closed loop and at least one continuous access opening adjacent said at least one continuous bore; and said at least one continuous bore and said at least one continuous access opening extending along a central portion of at least one longitudinal edge of each said rigid support means.

10. A tension mounting assembly for suspending flexible sheet material in a taut condition according to claim 9 wherein one said continuous bore and one said continuous access opening extend along a central portion of an inner longitudinal edge of each said rigid support means, each said rigid retaining member is engaged in said continuous bore provided at said inner longitudinal edge of each said rigid retaining means, and said rigid support means provide a visible framework along at least one peripheral edge of said flexible sheet.

11. A tension mounting assembly for suspending flexible sheet material in a taut condition according to claim 9 wherein one said continuous bore and one said continuous access opening extend along a central portion of an outer longitudinal edge of each said rigid support means, each said rigid retaining means is engaged in said continuous bore provided at said outer longitudinal edge of each said rigid support means, and said rigid support means is at least partially covered by said flexible sheet.

12. A tension mounting assembly for suspending flexible sheet material in a taut condition comprising:

a flexible sheet;

at least one rigid retaining member, at least a portion of at least one peripheral edge of said flexible sheet forming a closed loop, said at least one rigid retaining member mounted within said closed loop;

a generally planar support surface, bracket means attached to said generally planar support surface at locations corresponding to said at least one peripheral edge of said flexible sheet, said bracket means comprising a rigid, generally C-shaped bracket, a threaded adjustment means mounted on said generally C-shaped bracket, and an adjustable arm means threadedly engaged on said threaded adjustment means, said adjustable arm means comprising an angled projection extending away from said flexible sheet;

at least two rigid support means aligned and joined with and engaging each said at least one rigid retaining member mounted within said closed loop and each said rigid support means having engagement means engaging said adjustable arm means, whereby rotation of said threaded adjustment means causes axial displacement of said adjustable arm means, said rigid support means and said rigid retaining member, said axial displacement capable of tautening said flexible sheet.

13. A tension mounting assembly for suspending flexible sheet material in a taut condition according to claim 12 wherein said at least one rigid retaining member is mounted within said closed loop at each said peripheral edge of said flexible sheet, at least two rigid support means are aligned and joined and engage said rigid retaining member mounted within said closed loop and provided at each said peripheral edge of said flexible sheet.

14. A tension mounting assembly for suspending flexible sheet material in a taut condition comprising:

a flexible sheet;

at least one rigid retaining member mounted at least on one peripheral edge of said flexible sheet;

a generally planar support surface, bracket means attached to said generally planar support surface at locations corresponding to said at least one peripheral edge of said flexible sheet, said bracket means comprising a rigid, generally C-shaped bracket, a threaded adjustment means mounted on said generally C-shaped bracket, and an adjustable arm means threadedly engaged on said threaded adjustment means; and at least one rigid support means engaging each said at least one rigid retaining member, each said rigid support means having at least one continuous bore engaging said rigid retaining member and at least one continuous access opening adjacent said at least one continuous bore, said at least one continuous bore and said at least one continuous access opening extending along a central portion of at least one longitudinal edge of each said rigid support means, one said continuous bore and one said continuous access opening extending along a central portion of each of two opposite longitudinal edges of said rigid support means, each said rigid support means having engagement means engaging said adjustable arm means, whereby rotation of said threaded adjustment means causes axial displacement of said adjustable arm means and said rigid support means.

15. A tension mounting assembly for suspending flexible sheet material in a taut condition comprising:

a flexible sheet;

at least one rigid retaining member mounted at least on one peripheral edge of said flexible sheet;

a generally planar support surface, bracket means attached to said generally planar support surface at locations corresponding to said at least one peripheral edge of said flexible sheet, said bracket means comprising a rigid, generally C-shaped bracket having a first leg rigidly attached and oriented substantially perpendicular to a second leg provided with attachment means for attachment of said bracket means to said generally planar support surface, and a third leg rigidly attached and oriented substantially perpendicular to said second leg, a threaded adjustment means mounted on said generally C-shaped bracket, said first and third legs having bores receiving said threaded adjustment means, and an adjustable arm means threadedly engaged on said threaded adjustment means; and at least one rigid support means engaging each said at least one rigid retaining member, said rigid support means having a height between an upper and lower longitudinal edge corresponding at least to the distance between said first and third legs of said bracket means, each said rigid support means having engagement means engaging said adjustable arm means, whereby rotation of said threaded adjustment means causes axial displacement of said adjustable arm means and said rigid support means.

16. A tension mounting assembly for suspending flexible sheet material in a taut condition comprising:

a flexible sheet;

at least one rigid retaining member, at least a portion of at least one peripheral edge of said flexible sheet forming a closed loop, said at least one rigid retaining member mounted within said closed loop;

a generally planar support surface, bracket means attached to said generally planar support surface at locations corresponding to said at least one peripheral edge of said flexible sheet, said bracket means comprising a rigid, generally C-shaped bracket, a threaded adjustment means mounted on said generally C-shaped bracket, and an adjustable arm means threadedly engaged on said threaded adjustment means, said adjustable arm means comprising an angled projection extending away from said flexible sheet; and at least one rigid support means engaging each said at least one rigid retaining member mounted within said closed loop, each said rigid support means having a length substantially greater than the length of each said bracket means, each said rigid support means having engagement means engaging said adjustable arm means, whereby rotation of said threaded adjustment means causes axial displacement of said adjustable arm means, said rigid support means and said rigid retaining member; and said axial displacement capable of tautening said flexible sheet.

17. A tension mounting assembly for suspending flexible sheet material in a taut condition from a generally planar support surface comprising:

a flexible sheet;

at least one rigid retaining means, at least a portion of at least one peripheral edge of said flexible sheet forming a closed loop, each said retaining means mounted within said closed loop;

a plurality of bracket means attached to the generally planar support surface at locations corresponding to said at least one peripheral edge of said flexible sheet, each said bracket means comprising a rigid, generally C-shaped bracket, a threaded adjustment means mounted on said generally C-shaped bracket, and an adjustable arm means threadedly engaged on said threaded adjustment means;

at least one rigid support means engaging each said at least one rigid retaining means mounted within said closed loop and each said rigid support means having engagement means engaging said adjustable arm means, whereby rotation of said threaded adjustment means causes axial displacement of said adjustable arm means, said rigid support means and said rigid retaining means, said axial displacement capable of tautening said flexible sheet;

said bracket means comprising said C-shaped bracket having a first leg rigidly attached and oriented substantially perpendicular to a second leg provided with attachment means for attachment of said bracket means to said generally planar support surface, and a third leg rigidly attached and oriented substantially perpendicular to said second leg, said first and third legs having bores receiving said threaded adjustment means; and said adjustable arm means having an angled projection which extends beyond terminal edges of said first and third legs of said bracket means and is oriented at an obtuse angle with respect to said first and third legs.

18. A tension mounting assembly for suspending flexible sheet material in a taut condition according to claim 17 wherein said engagement means on said rigid support means comprises a continuous angled groove having a configuration and dimension to securely engage said angled projection of said adjustable arm means.

19. A tension mounting assembly for suspending flexible sheet material having at least one rigid retaining member mountable on at least one peripheral edge in a taut condition, said assembly comprising:

a generally planar support surface, bracket means attachable to said generally planar support surface at locations corresponding to said at least one peripheral edge of a flexible sheet, said bracket means comprising a rigid, generally C-shaped bracket, a threaded adjustment means mountable one each said generally C-shaped bracket, and an adjustable arm means threadedly engageable on each said threaded adjustment means, said adjustable arm means comprising an angled projection extending away from said flexible sheet; and at least one rigid support means in which said at least one rigid retaining member is engageable, each said rigid support means having engagement means wherein said angled projection is engageable.

20. A tension mounting assembly for suspending flexible sheet material in a taut condition comprising:

a flexible sheet;

at least one rigid retaining member, at least a portion of at least one peripheral edge of said flexible sheet forming a closed loop, said at least one rigid retaining member mounted within said closed loop;

a generally planar support surface, bracket means attached to said generally planar support surface at locations corresponding to said at least one peripheral edge of said flexible sheet, said bracket means comprising a rigid, generally C-shaped bracket, a threaded adjustment means mounted on said generally C-shaped bracket, and an adjustable arm means threadedly engaged on said threaded adjustment means, said adjustable arm means comprising an angled projection extending away from said flexible sheet;

at least one rigid support means engaging each said at least one rigid retaining member mounted within said closed loop and each said rigid support means having engagement means engaging said adjustable arm means, whereby rotation of said threaded adjustment means causes axial displacement of said adjustable arm means, said rigid support means and said rigid retaining member, said axial displacement capable of tautening said flexible sheet; and reinforcement means having at least two generally rectangular parallel walls defined by inner surfaces of said generally C-shaped bracket, said two walls aligned parallel to said threaded adjustment means and adjacent said adjustable arm means.

* * * * *